United States Patent [19]

Trull et al.

[11] Patent Number: 4,623,174

[45] Date of Patent: Nov. 18, 1986

[54] LATCHBOLT WITH ADJUSTABLE BACKSET

[75] Inventors: Jeffrey G. Trull, Matthews; Sidney J. Lampley, Monroe, both of N.C.

[73] Assignee: Yale Security Inc., Charlotte, N.C.

[21] Appl. No.: 705,792

[22] Filed: Feb. 26, 1985

[51] Int. Cl.[4] ..... E05B 9/10

[52] U.S. Cl. ..... 292/1; 70/461; 292/169; 292/337

[58] Field of Search ..... 292/1, 337, 169, DIG. 60, 292/DIG. 51, 169.23; 70/461, DIG. 12

[56] References Cited

U.S. PATENT DOCUMENTS

| | | | |
|---|---|---|---|
| 1,701,790 | 2/1929 | Morin | 70/461 |
| 1,764,946 | 6/1930 | Flynn | 292/DIG. 51 X |
| 2,299,181 | 10/1942 | Schlage | 292/337 |
| 2,719,744 | 10/1955 | Schlage | 292/1 |
| 2,765,187 | 10/1956 | Crandell | 292/1 |
| 2,776,155 | 1/1957 | Gerlach | 292/1 |
| 2,822,202 | 2/1958 | Welch | 292/1 |
| 2,878,049 | 3/1959 | Linton | 292/337 |
| 2,937,897 | 5/1960 | Soderberg | 292/1 |
| 3,046,042 | 7/1962 | Kane | 292/1 |
| 3,441,269 | 4/1969 | Doyle | 292/337 |
| 4,427,224 | 1/1984 | Bergen | 292/1 X |
| 4,525,004 | 6/1985 | Tanaka | 292/337 X |

*Primary Examiner*—Robert L. Wolfe
*Assistant Examiner*—Lloyd A. Gall

[57] ABSTRACT

A latchbolt has an adjustable backset made possible by the selection of one of a plurality of insets to interfit with the latchbolt actuator stub. The insets provide a selection in the distance between the actuator work shoulders and the end of the stub. A sleeve telescopes over the latchbolt tailpiece to hold the inset in position.

6 Claims, 6 Drawing Figures

LATCHBOLT WITH ADJUSTABLE BACKSET

BACKGROUND OF THE INVENTION

1. Field of the Invention

This invention relates to a door latchbolt having an adjustable backset so that it can accommodate architectural preferences relating to the distance from the edge of the door to the knob or handle. More specifically, this invention relates to a door latch of adjustable backset in which a selected one of a variety of insets may be used to result in the desired length of latch actuator.

2. Description of the Prior Art

The prior art is replete with latchbolts having adjustable backsets. Examples are U.S. Pat. No. 2,299,181 to Schlage granted Oct. 20, 1942 and U.S. Pat. No. 2,719,744 also to Schlage granted Oct. 4, 1955. The backset adjustment means of the prior art have often been complicated and consisted of many parts and have been given to malfunctions.

SUMMARY OF THE INVENTION

The present invention relates to a latchbolt having an adjustable backset based on a simple inset which can be selected by a carpenter from a number of insets of different dimension and which can be engaged in the tailpiece of the latchbolt and held securely in position by a simple retaining sleeve held in appropriate position on the latchcase tail.

Further objects and features of the invention will be apparent from a reading of the following specification and examination of the appended drawings all of which relate to a nonlimiting embodiment of the invention.

DETAILED DESCRIPTION OF THE PREFERRED EMBODIMENT

Figure 1:
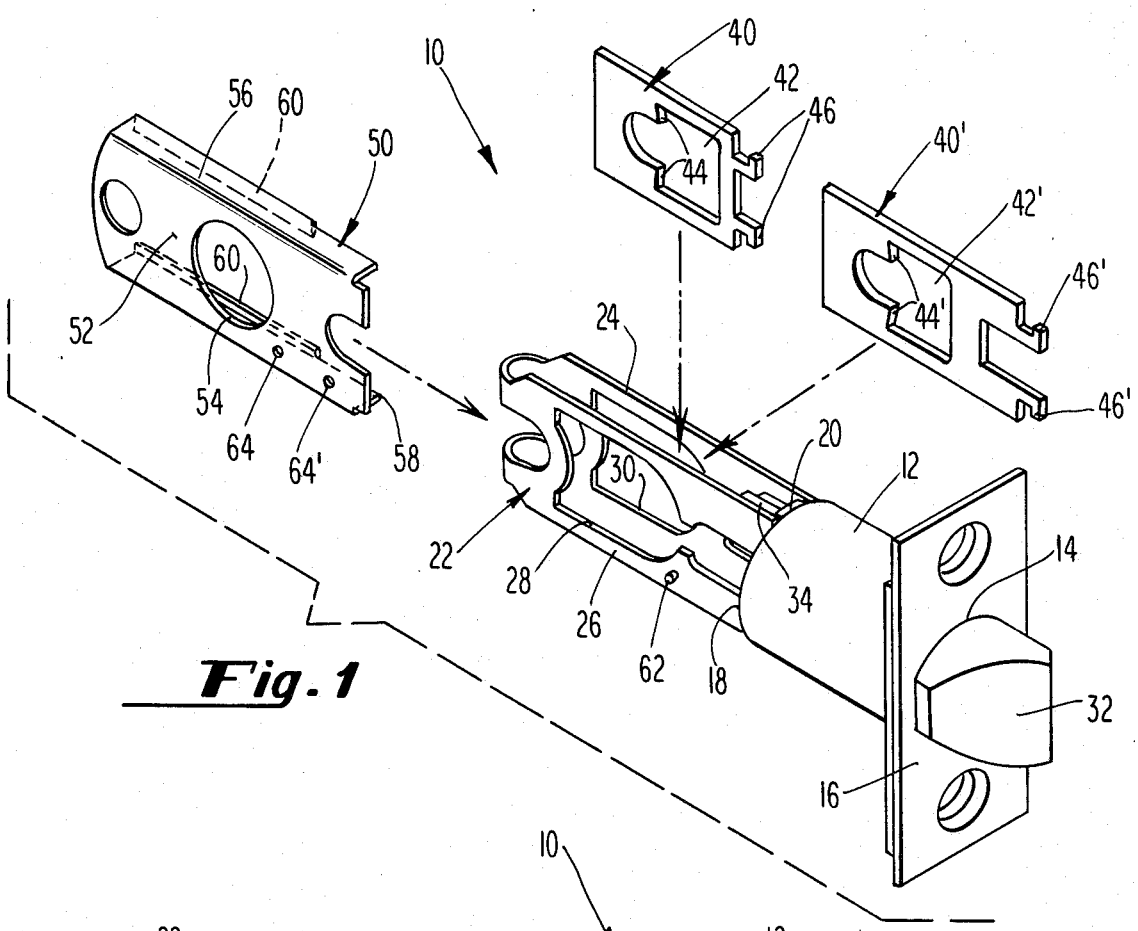
FIG. 1 is an exploded view of a latchbolt assembly embodying the invention and showing two different backset insets which may be selected alternately for use.
Figure 6:
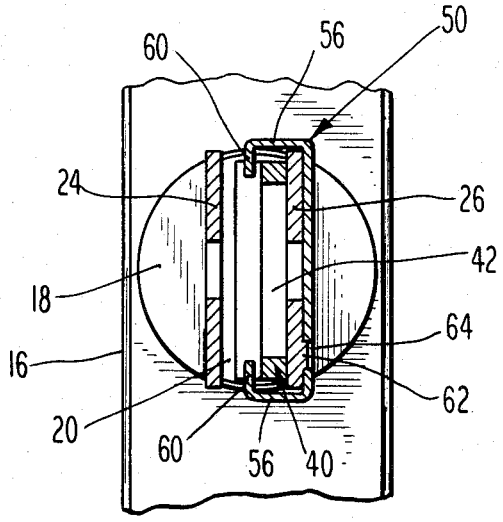
FIG. 6 is a sectional view taken on the line 6—6 of FIG. 3.

A preferred form of a latchbolt embodying the invention is shown in the exploded view in FIG. 1 and generally designated 10. It comprises a tubular latchcase 12 having an opening 14 at one end surrounded by a face plate 16. The other end 18 of the case is formed with a rectangular opening 20 (FIG. 6). A U-shaped tailpiece element 22 has the ends of its two flat legs 24 and 26 secured to the opposite sides of the opening 20 in the end 18 of the latchcase in the conventional manner. Suitable openings 28 and 30 are formed in the legs 26 and 24.

The latchcase 12 is provided with a conventional springpressed latchbolt 32 and the latchbolt actuator stub 34 extends out of the opening 10 at the back of the latchcase (FIG. 2) and is disposed flat against the leg 26 of the tailpiece. The actuator stub 34 is formed at its distal end with a pair of spaced ends having inwardly directed fingers 36 which oppose each other.

Figure 4:
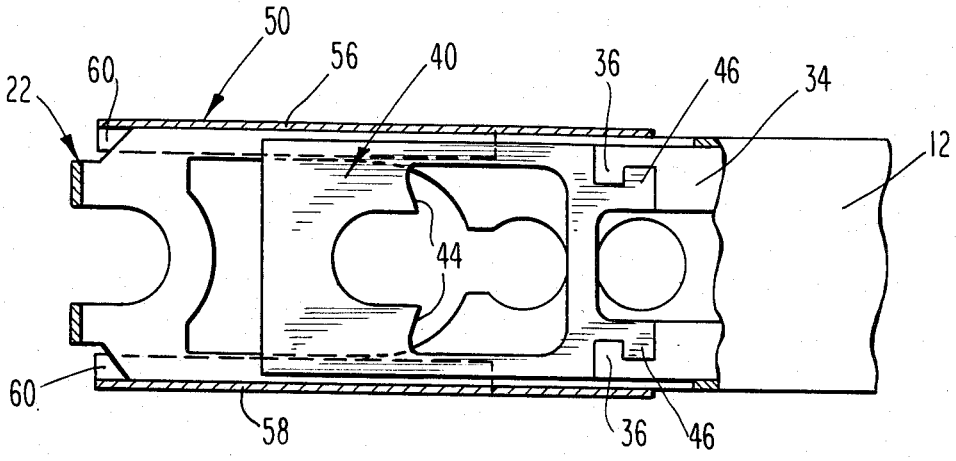
FIG. 4 is a fragmentary sectional view taken on the line 4—4 of FIG. 2.
Figure 5:
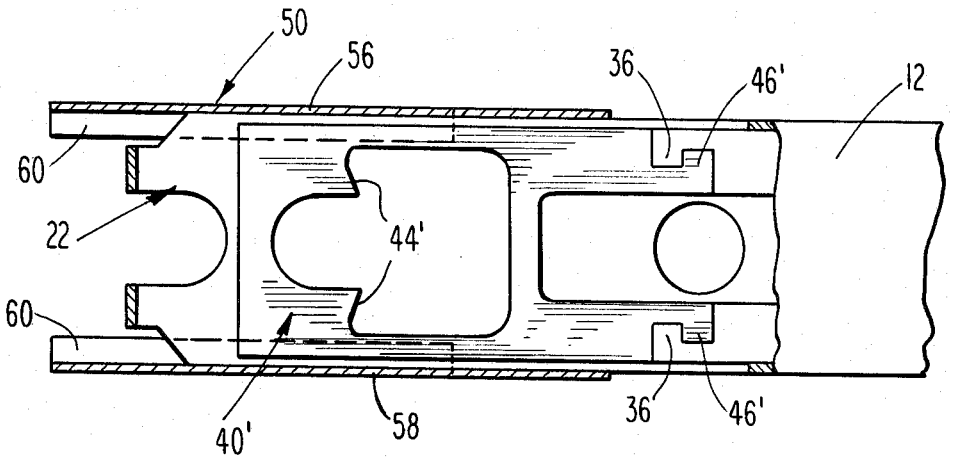
FIG. 5 is similar to FIG. 4 but showing the latchbolt with a different inset.

In accordance with the invention, a plurality of sizes of insets are provided and illustratively shown as 40 and 40' in FIG. 1. These insets are each provided with a central opening 42 and 42' having shoulders 44 and 44' against which the latch pullback works in the conventional manner. These insets may be selectively inserted into the latchbolt assembly as shown in FIG. 4 and 5. At their end closer to the latchbolt, the insets are each provided with a reduced area and outwardly directed projections 46 and 46', respectively. The fingers 36 and the projections 46 or 46' interfit as shown in FIGS. 4 and 5 so that the insets 40 and 40', respectively, become extensions of the latch actuator stub 34.

The difference in dimensions between the insets 40 and 40' result in the adjustable backset which is an essential of the invention. More specifically, the difference between the projections 46 and 46' and the shoulders 44 and 44', respectively, determine the backset capabilities of the respective insets. It is against the shoulders 44 and 44', respectively, that the pullback cam on the spindle of the door knob works to activate the latch and it can be seen from comparing FIGS. 4 and 5 that the inset 40' of FIG. 5 permits a much greater backset than the inset of FIG. 4.

Figure 2:
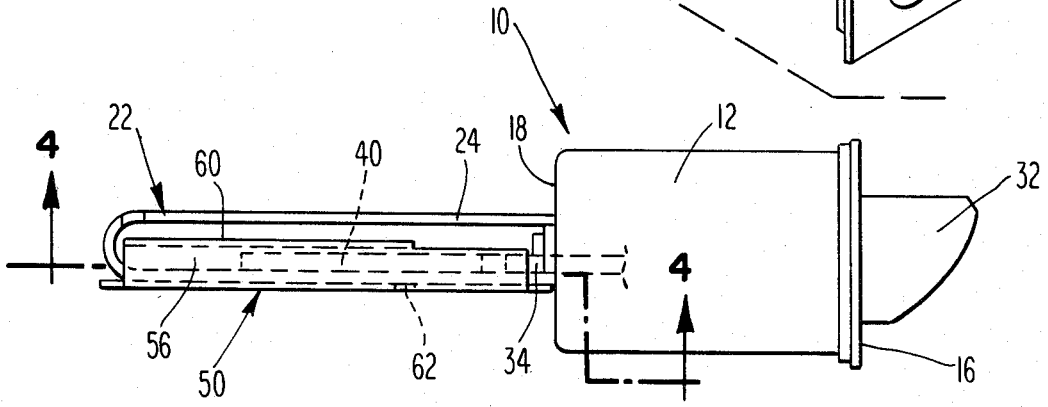
FIG. 2 is a top plan view of a latchbolt embodying the invention.
Figure 3:
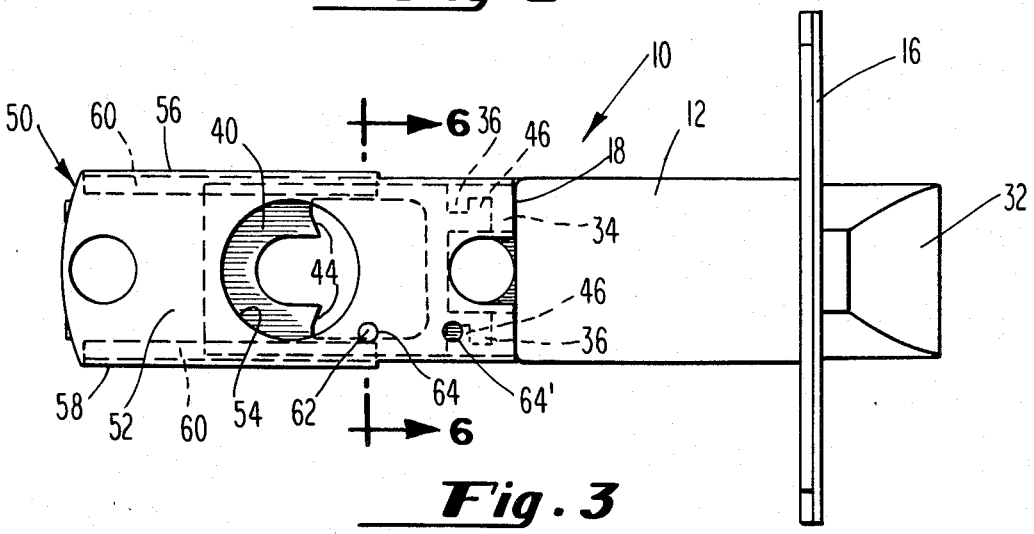
FIG. 3 is a side elevational view.

Continuing the disclosure of the invention, it will be seen from FIG. 2 that the inset, whichever one is selected, 40 or 40', fits flatly against the leg 26 of the tailpiece. The stub 34 and the selected insert 40 or 40' when assembled together form a flat co-planar extension. To immobilize the inset against displacement in a direction away from the leg 26, but still permitting the inset to slide longitudinally of the leg 26, a retaining sleeve 50 of sheet metal of generally C-shaped cross section is provided.

As best shown in FIG. 1 the retaining sleeve 50 is formed with a wall 52 having a suitable enlarged aperture 54. The sleeve 50 also comprises the top wall 56 and the bottom wall 58 and partial inside wall 60 to complete the retaining function.

Referring to FIG. 1 the leg 26 may be formed with an outward nib or detent 62. The sleeve may be formed with aligned detent-receiving openings or recesses 64. Means 62 and 64 are prearranged and used by the installer so that the opening 54 of the sleeve 50 in assembly aligns with the shoulders 44 or 44' of the insert to permit ready passage of the door knob spindle and pullback in final installation. The relative positioning of the sleeve 50 by the means 62, 64 is shown respectively in FIGS. 4 and 5.

From the above description, it will be apparent how the carpenter may in the field select the proper backset for a latchbolt under the invention. More specifically, if, for instance, a $2\frac{3}{8}''$ backset is desired, the inset 40 may be selected, made to interfit with the stub 34 and positioned against the leg 26. The sleeve 50 is then slid endwise over the leg 26, including the inset 40 to immobilize the inset with respect to movement away from the leg 26. If, on the other hand, a backset of $2\frac{3}{4}''$ is selected, the carpenter in assemblying the unit will select the larger inset 40', position it to interfit with the projections 46' engaging behind the fingers 36 and then slide on the sleeve 50 to hold the inset in that position, permitting only its sliding movement lengthwise of the tail 22.

It should be noted that for the smaller of the insets 40 a recess 64 is made to receive the detent 62, whereas for the larger inset 40' the cavity 64' is aligned with the detent 62. This assures that the opening 54 will permit passage of the latch operator's spindle in its work zone adjacent shoulders 44 or 44'.

While this invention has been shown in one form, it is not so limited but is capable of being utilized in many different embodiments, all falling within the scope of the following claim language or equivalents thereof.

We claim:

1. A door latch having an adjustable backset comprising a tubular latchcase having an open end surrounded by a face plate, the other end being partly closed except for a rectangular aperture and having a latchcase tail comprising a U-shaped element both legs of which are flat and secured to the latchcase on the sides, respectively, of the aperture, a latchbolt in the latchcase and extending out through the open end of the latchcase, a latchbolt operator associated with the latchbolt and extending out of the aperture, the operator being aligned parallel to and against one of the legs, the operator terminating in a pair of spaced ends with opposed fingers, directed inwardly toward the longitudinal center line of the tail, a backset inset comprising a plate having at its operator-engaging end recesses, also inwardly directed, adapted to receive the inwardly directed fingers, the inset having at a preset distance from the fingers pullback shoulder means, the inset fitting in the latchcase tail against the said one leg, and coplanar with the operator, and an elongate slide of C-shaped cross-section adapted to slide along said leg to hold the inset thereagainst, an inside wall of said slide being received between the legs of the U-shaped element adjacent said inset to retain said fingers in engagement with said recesses, the slide being apertured to permit passage of a pullback, whereby the assembly can be taken apart and the inset disengaged and replaced with an inset with a different preset distance.

2. A door latch as claimed in claim 1 wherein the said one leg and the slide have cooperating detent means and detent-engaging means to assure that the slide is in the proper longitudinal position on the leg so that the slide aperture aligns with the pullback shoulder means on the selected inset.

3. A door latch having an adjustable backset comprising a tubular latchcase having an open end surrounded by a face plate, the other end being partly closed except for a rectangular aperture and having a latchcase tail comprising a U-shaped element both legs of which are flat and secured to the latchcase on the sides, respectively, of the aperture, a latchbolt in the latchcase and extending out through the open end of the latchcase, a latchbolt operator associated with the latchbolt and extending out of the aperture, the operator being aligned parallel to and against one of the legs, the operator terminating in one-half of laterally engaging coupling means, a backset inset comprising a plate having at one end the other half of the coupling means, the inset having at a preset distance from the said other half of said coupling means pullback shoulder means, the inset fitting in the latchcase tail against the said one leg and coplanar with the operator, with the halves of the coupling means interengaging, and an elongate slide of C-shaped cross-section disposed to slide along said one leg to hold the inset thereagainst, an inside wall of said slide being received between the legs of the U-shaped element adjacent said inset to retain said halves of said coupling means engaged, the slide being apertured to permit passage of the pullback, whereby the assembly can be taken apart and the inset decoupled from the operator and replaced with an inset having a different preset distance.

4. A door latch as claimed in claim 3 wherein the said one leg and the slide have cooperating detent means and detent-engaging means to assure that the slide is in the proper longitudinal position on the leg so that the slide aperture aligns with the pullback shoulder means on the selected inset.

5. A door latch having an adjustable backset comprising a tubular latchcase having an open end surrounded by a face plate, the other end being partly closed except for a rectangular aperture and having a latchcase tail comprising a U-shaped element both legs of which are flat and secured to the latchcase on the sides, respectively, of the aperture, a latchbolt in the latchcase and extending out through the open end of the latchcase, a latchbolt operator associated with the latchbolt and extending out of the aperture, the operator being aligned parallel to and against one of the legs, the operator terminating in hook means, a flat, planar backset inset comprising a plate having at its end closer to the latchbolt complementing hook means adapted to engage the hook means, the inset having at a preset distance from the complementing hook means end pullback-engaging shoulders, the inset fitting in the latchcase tail against the said one leg as a coplanar extension of the operator with the hook means and the complementing hook means engaged, and an elongate slide of C-shaped cross section adapted to slide along said one leg to hold the inset thereagainst, an inside wall of said slide being received between the legs of the U-shaped element adjacent said inset to retain said hook means engaged, the slide being apertured to permit passage of a pullback, whereby the assembly can be taken apart and the inset unhooked and replaced with an inset with a different preset distance.

6. A door latch as claimed in claim 5 wherein the said one leg and the slide have cooperating detent means and detent-engaging means to assure that the slide is in the proper longitudinal position on the leg so that the slide aperture aligns with the pullback engaging shoulders on the selected inset.

* * * * *